US005128845A

United States Patent [19]

Hoffmeier

[11] Patent Number: 5,128,845

[45] Date of Patent: Jul. 7, 1992

[54] SUBMERSIBLE ELECTRICAL APPLIANCE, ESPECIALLY A LAMP

[75] Inventor: Dieter Hoffmeier, Ibbenbüren, Fed. Rep. of Germany

[73] Assignee: Oase-Pumpen Wübker Söhne GmbH & Co., Maschinenfabrik, Hörstel-Riesenbeck, Fed. Rep. of Germany

[21] Appl. No.: 578,701

[22] Filed: Sep. 6, 1990

[30] Foreign Application Priority Data

Sep. 12, 1989 [DE] Fed. Rep. of Germany ..... 8910902

[51] Int. Cl.[5] ..... F21V 31/02

[52] U.S. Cl. ..... 362/187; 362/267

[58] Field of Search ..... 362/158, 187, 267, 277, 362/319

[56] References Cited

U.S. PATENT DOCUMENTS

| | | | |
|---|---|---|---|
| 2,339,670 | 1/1944 | Benson | 362/267 |
| 2,582,659 | 1/1952 | Tamminga | 362/267 |
| 3,005,908 | 10/1961 | Farina | 362/267 |
| 3,196,266 | 7/1965 | Grosser | 362/267 |
| 3,248,531 | 4/1966 | Dover | 362/267 |
| 4,216,411 | 8/1980 | Ehret et al. | 362/267 |
| 4,343,033 | 8/1982 | Suzuki | 362/267 |
| 4,388,674 | 6/1983 | Sano | 362/187 |
| 4,509,106 | 4/1985 | Mayer et al. | 362/267 |
| 4,683,523 | 7/1987 | Olsson et al. | 362/158 |
| 4,687,965 | 8/1987 | Sanders et al. | 362/267 |
| 4,996,635 | 2/1991 | Olsson et al. | 352/158 |

FOREIGN PATENT DOCUMENTS

| | | | |
|---|---|---|---|
| 1287833 | 2/1962 | France | 362/267 |
| 2493958 | 5/1982 | France | 362/267 |

*Primary Examiner*—Richard R. Cole
*Attorney, Agent, or Firm*—Jordan and Hamburg

[57] ABSTRACT

A submersible electrical appliance includes a housing having a water-tight function chamber and at least one water-tight junction chamber, the housing having a bulkhead wall separating the function chamber from the junction chamber, and internal water-tight compression electrical fittings passing through the bulkhead and extending beween the function chamber and the junction chamber.

26 Claims, 3 Drawing Sheets

SUBMERSIBLE ELECTRICAL APPLIANCE, ESPECIALLY A LAMP

The invention relates to a submersible electrical appliance.

Submersible electrical appliances must be able to withstand exceedingly critical operating conditions, since such appliances must remain protected against the penetration of water in spite of operating over long periods of time under water. Particularly in the case of submersible lamps the problem often is encountered that, due to the pumping effect produced by turning on and off very hot lamps, amount other things, they suck in water, especialy when the gaskets are critically designed or are situated in reach of adjusting means, such as variable-focus reflectors. The consequences of resultant failures can easily be multiplied in conventional submersible appliances by the fact that a whole series of submersible appliances are connected together by electrical cables, and that these cables in the long run act as hoses that carry the water and flood even tight housings through the electrical lines.

It is the purpose of the invention to provide better protection for submersible electrical appliance againgst leakage and its consequences, in a very simple and failure-proof manner.

It has been found to be a surprisingly effective means for improving the operational reliability of submersible appliances, such as submersible lamps, but also motors, pumps and the like, but one which is easy to achieve, to bring the electrical incoming and outgoing cables, not into a generally open interior of the enclosure, but into a separate junction chamber. Electrical connections may run out to the appliance chamber from the junction chamber, through or around the bulkhead, only in a watertight manner. So, if the appliance chamber becomes flooded with water due to a leak--say a crack in the wall or damage to a gasket due to a mechanical or thermal cause--the submersible appliance normally fails in a more or less short time. The area of the cable terminal and especially the cable itself will remain unaffected by it. The breakdown will remain isolated.

It is desirable furthermore to see to it that the submersible appliance has a second junction chamber bulkheaded on all sides and provided with electrical compression fittings, since submersible appliances of this kind are typically constructed such that a plurality of cables can be connected, so that a submersible appliance also serves simultaneously as a distribution box. If in this case the incoming cable is sealed off from the outgoing cable such that the two are connected with one another electrically only through one wall, the propagation of the damage along a cable is prevented. Water entering from another leaky submersible appliance, from a damaged cable, or even from the seal of the incoming cable cannot get to the outgoing cable and damage the next appliance in the line.

At least just as important as the prevention of secondary damage is the prevention of primary damage. In this regard, a special weak point exists in seals between moving parts, as in the case of a rotary focusing tube. In one embodiment, it is possible, especially in the case of adjusting devices which are occassionally to be released on opened, to secure the actual of adjustment against any unintentional or critical opening movement. The catch that is to be provided for setting the adjustment range can be configured, in an especially simple and elegant manner, so as to be integral with one or the other of the two parts moving on one another, i.e., with the housing or the tube if it is injection molded from plastic.

An embodiment of the subject matter of the invention is represented in the drawing and will be further described hereinbelow.

DESCRIPTION OF THE PREFERRED EMBODIMENTS

Figure 1:
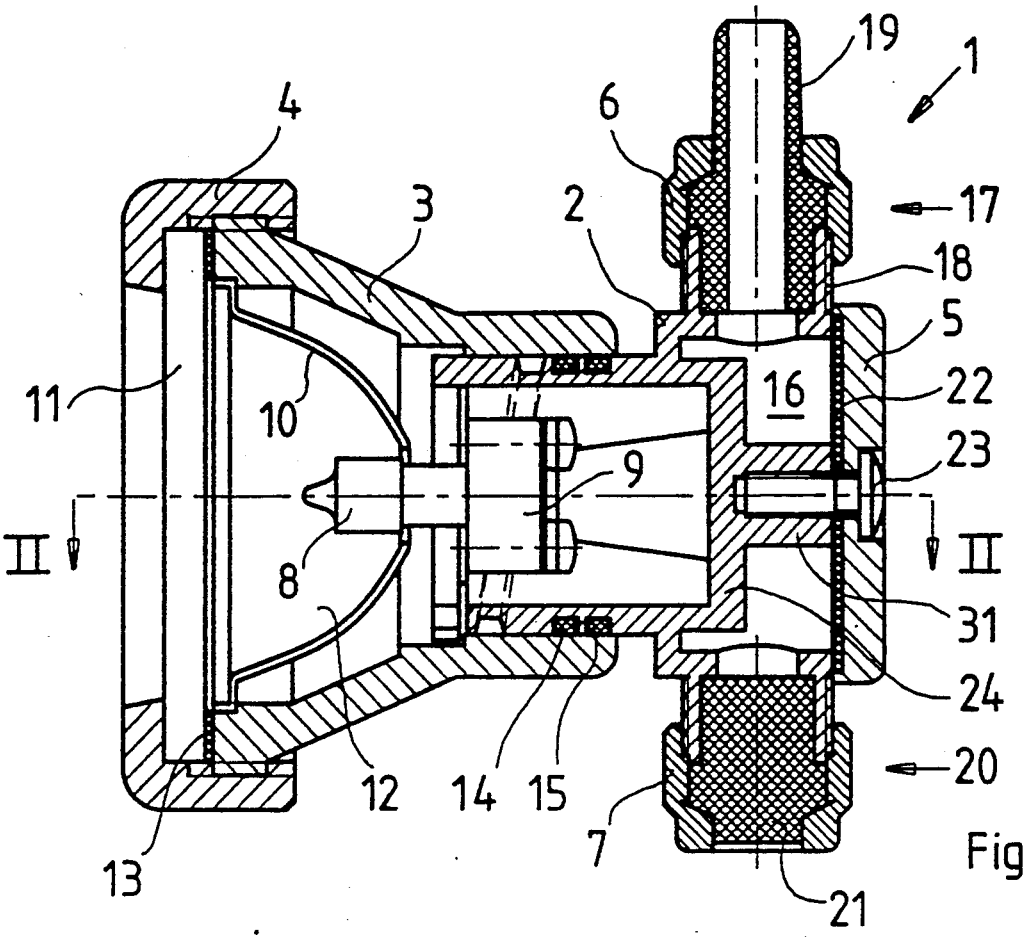
FIG. 1 shows a longitudinal section through a submersible lamp.

The submersible lamp shown in its entirety and identified as 1 comprises a housing 2, a focusing tube 3, a front lens clamping ring 4, a junction chamber cover 5, and two (identical) compression nuts 6 and 7, all these parts being injection molded from plastic.

In the housing a bulb 8 is mounted by means of a socket 9, while a reflector 10 is located on the focusing tube 3 is helically adjustable with respect to the housing 2, and will be further discussed below. The sealing of the appliance chamber 12 enclosed by housing 2, focusing the tube and front lens 11 is acheived by a flat ring gasket 13 between the front lens 11 and focusing tube 3 and by a double O-ring seal 14, 15.

On the back of the housing a junction chamber 16 is formed into which a cable can be introduced through a compression fitting 17. The compression fitting 17 includes not only a compression nut threaded on a nipple 18 of the housing 2 but also a compression seal 19.

A compression fitting 20 on the opposite side differs from the compression fitting 17 in that it is closed by a plug 21 which is made of elastomeric material like the compression seal 19. The plug can be replaced by a second compression seal for the purpose of connecting a second (outgoing) cable. The junction chamber cover is sealed against the housing 2 by a disk gasket 22, while a central cover screw 23 provides the seating and compression.

The junction chamber 16 is closed off from the appliance chamber 12 by a bulkhead 24 to prevent the passage of water from the appliance chamber 12 into the junction chamber 16 even if the appliance chamber should develop a leak due to rupture or leakage of the seals, in the case of mechanical damage or cracking due to the great thermal stress. This prevents an especially nasty result of leaks in submersible appliances, in which water runs inside of a cable to other submersible appliances, such as lamps, motors, power sources and the like, as if through a hose. It also prevents, however, the inverse passage of water from the junction chamber into the appliance chamber if, for example, water enters the junction chamber due to damage to the cable or to the entry of water into other submersible appliances connected directed directly or indirectly by cables, or due to a defect in the compression fitting 17.

Figure 2:
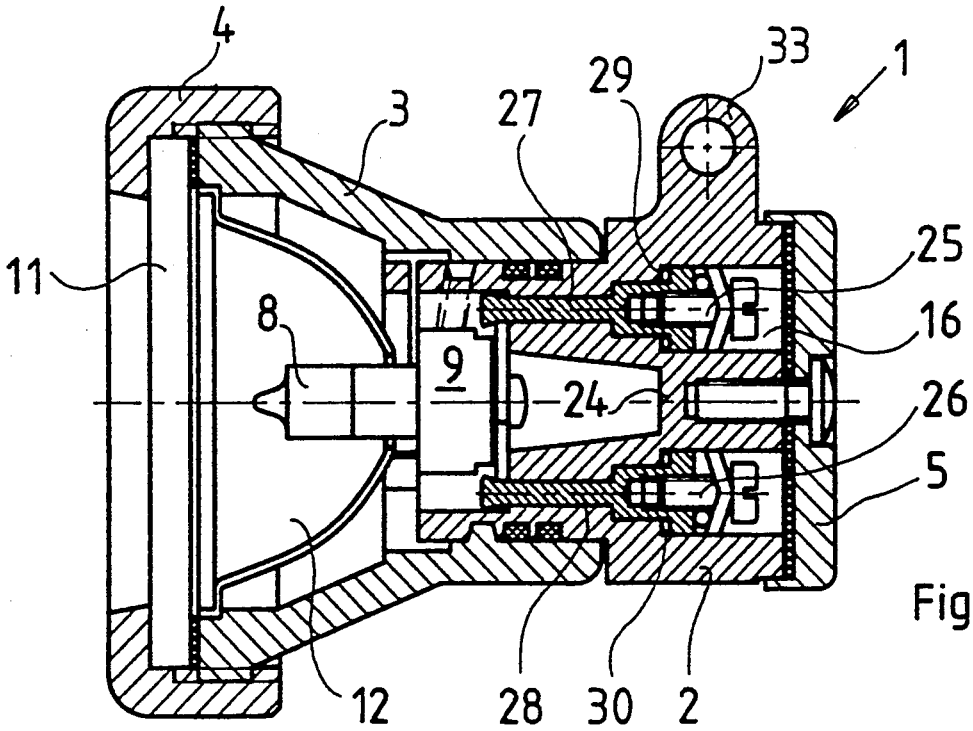
FIG. 2 is a section along line II—II in FIG. 1.

It is evident that the bulkheading function fo the wall 24 must not be endfangered by any electrical lead-throughs tht might have to be provided. As it can be seen in FIG. 2, two screw terminals 25, 26, are accessible in the junction chambers, and bear the socket 9 on pins 27, 28. The pins 27, 28, are fitted into through-bores in the housing and are sealed by O-rings 30. It is evident that pins incorporated by casting can serve the same purpose and provide for a water-tight, electrically conductive connection between the socket 9 and the connecting terminals.

In the embodiment represented only two screw terminals are provided, which also permit, if desired, the connection of an outgoing cable through the compression fitting 20. A very advantageous and only slightly more complex modification provides for dividing the junction chamber 16 into two chambers, so tht one junction chamber associated with the compression fitting 17 and one associated with compression fitting 20 would be the result, in which case an additional bulkhead would run at about the level of a screw socket 31 provided there to accommodate the cover screw 23. Then, of course, each of the junctions chambers thus formed would have to be equipped with screw terminals, which would have to be connected to one another either through the additional bulkhead or paired together at the lamp socket.

In the above it is obvious that the configuration using two screw terminals is typical for a low-voltage system, whereas in the case of mains-voltage systems additional ground connections and grounding compression fittings are to be provided.

Figure 3:
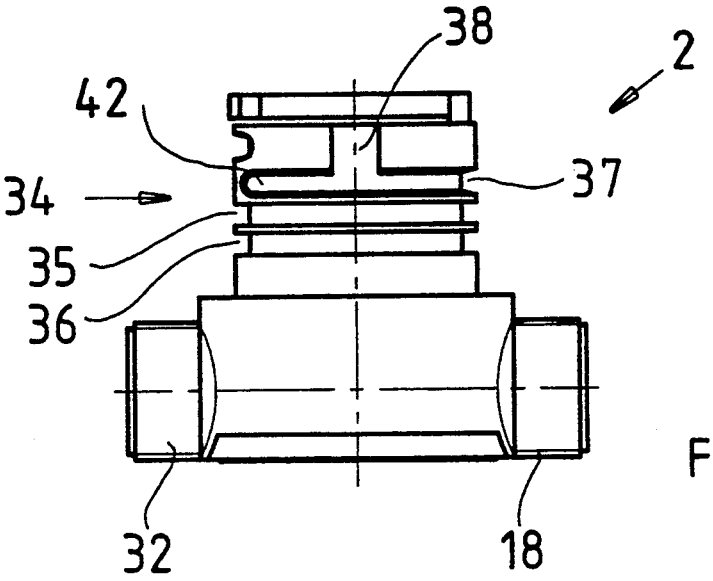
FIG. 3 is a view of the housing for the submersible lamp of FIGS. 1 and 2.
Figure 4:
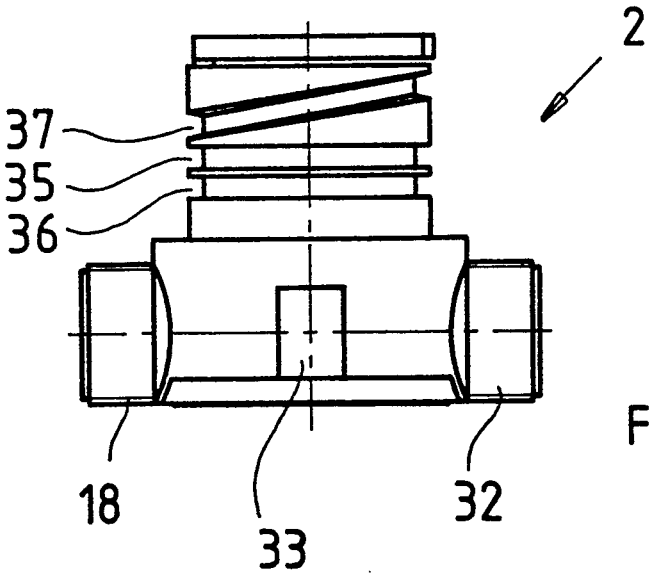
FIG. 4 is a view opposite that of FIG. 3.
Figure 6:
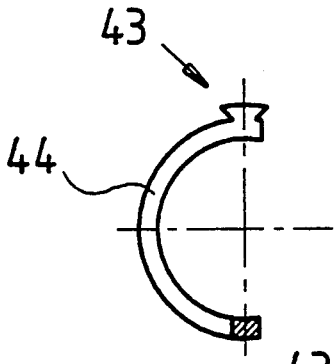
FIG. 6 is a section on line VI—VI in FIG. 5.
Figure 5:
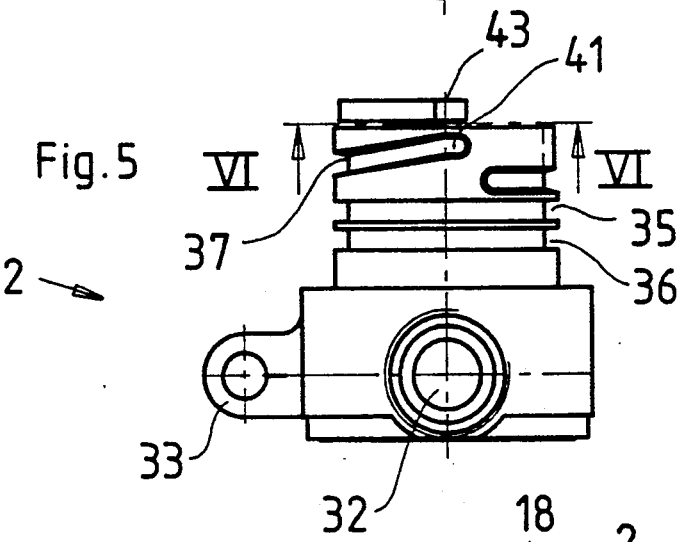
FIG. 5 is a rotated view of FIGS. 3 and 4.

FIGS. 3 to 8 show the interaction of the housing 2 and focusing tube 3, which are to be as easy as possible to assemble and are to be rotatable against one another to vary the focus, and any separation of the focusing tube 3 and housing 2 from one another, or any disengagement of the O-rings 14 and 15, is to be reliably prevented. The housing 2 is represented in FIGS. 3, 4 and 5 in three views whose relationship to one another can be seen at a glance ont he basis of the above-mentioned threaded nipple 18, an indentical threaded nipple on the other side, and an intergral mounting lug 33. To accommodate the focusing tube 3, the housing 2 forms a cylindrical surface 34 in which two circumferential grooves 35 and 36 are created to receive the O-rings 14 and 15. Also, a guiding groove 37 is created in the end cylinder surface 34, which ascends at an angle on the one side (cf. FIG. 4) and describes the course of a thread for movement over about half a revolution. On the other side (cf. FIG. 3) the guiding groove 37 does not ascend, and merges T-wise in a central section with an insertion groove 38.

Figure 8:
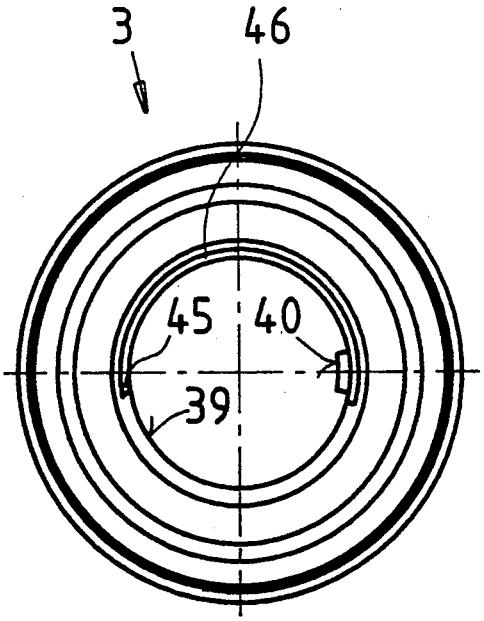
FIG. 8 is a top view of a tube.
Figure 7:
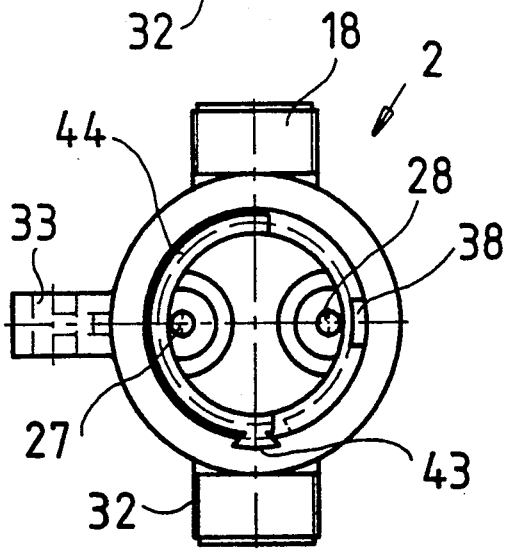
FIG. 7 is a top view of the housing part of FIG. 5.

At this point it is best to study FIGS. 7 and 8, in which the housing and the focusing tube 3 which can be fitted over it are represented in plan. The focusing tube 3 has an inner cylindrical surface 39 which fits onto the outer cylindrical surface 34 of housing 2; a guiding stud 40 projects from this inner cylindrical surface, and upon insertion it fits into the insertion groove 38 and, since it is substantially flat tangentially, it can also run along the guiding groove 37.

This results in an assembling movement in which assurrance is provided that the (double) sealing by the O-rings 14 and 15 is brought fully into engagement between the cylinder surfaces 34 and 39 by a first section of the movement along the insertion groove 38 before both parts are moved in a second section of movement along the guiding groove 37, by which the focusing function anticipated in the use of the lamp is to be provided.

The movement of the two parts with respect to one another is therefore different when they and when they are in operation; the first part of the assembling movement involves a substantial axial shifting of the cylinder surfaces past of the movement involves the rotational function which in this case is an axial movement for focusing. Basically, a succession of two parts of the movement of this kind could also be achieved in a continuous helical guidance wherein a first part of it produces a secure seal, and a second part permits the actual focusing. The present embodiment, however, has the advantage that the housing 2 and the focusing tube 3 cannot be disengaged by simple rotation. The helix of movement leads on the one hand, precisely upon the shifting of the focusing tube 3 away from the housing 2, to a terminal abutment 41. In the opposite direction the guiding groove 37 terminates in a dead section 42, so that no accidental separation of the parts from one another can be produced by movement all the way through.

This, however, constitutes only an additional provision against accidental opening of the housing 2, since the housing 2 and focusing tube 3 are protected by a catch 43 against return of the stub 40 to the insertion groove 38 when both parts have been rotated after assembly into the second part of the movement.

The catch 43 is formed at the end of a leaf spring 44 formed integrally with the housing part 2, the spring 44 forming a semicircle close to the cylinder surface 34. The catch 43 is pressed inwardly upon assembly and, when turned against an undercut abutment 45, it snaps into the inner cylindrical surface 39 of the focusing tube 3 after the stub 40 has been forced into the guiding groove 37. The abutment 45 is at the end of a groove 46 for the accommodation of the catch 43.

As it can be seen, the angular position of the catch 43 with respect to the insertion groove 38 and the guiding groove 37 is not important. Neither is the position of the abutment 45 in any way fixed in its angular position in relation to the stud 40. It is to noted, howver, that the angular position in which the catch 43 encounters the abutment 45 finds the stud 40 in the guiding groove 37 at the point where an abutment toward the insertion groove 38 is to be formed for the rotary movement. The axial movement of the focusing tube 3 with respect to the housing 2 which is thus limited can be understood by comparing FIG. 1 with FIG. 2. In FIG. 1 can be seen the extended position of the focusing tube in which the stub 40 strikes against the abutment end 41 of the guiding groove 37, while in FIG. 2 (which to this extend does not precisely represent the section along line II—II in FIG. 1) is shown the retracted position of focusing tube 3 in which the catch 43 is against the abutment 45.

As it can also be seen from a comparison of FIGS. 7 and 8, the spring arm 44 of the catch 43 is compressed upon striking agains the abutment 45. If force is applied against this abutment, the spring arm 44 lays itself against the inner cylindrical surface 39 of the focusing tube 3 and is supported by the latter. This promotes reliability of operation even in spite of improper handling.

It is to be understood in the above that what is important is the functional association of the parts which makes interchangeability easily possible. Thus the focusing tube can reach into the housing and form an external cylindrical surface, and the catch can be mounted on the focusing tube without the need to scrifice another function.

The described measures are not limited to submersible lamps. Instead a bulkheaded junction chamber as well as an adjusting means secured against release is applicable in many other submersible applicances.

What is claimed is:

1. A submersible electrical appliance comprising a focusing tube and a housing part, said tube having an outside cylindrical section, said housing part having an inside cylindrical section receiving said outside cylindrical section, sealing means sealing said inside and outside cylindrical sections, a projection on one of said cylindrical sections, a groove in the other of said cylindrical sections having a first groove portion receiving said projection as said outside and inside cylindrical sections are moved relative to one another in an axial direction to an axial position to sealingly engage said sealing means during assembly of the appliance, said groove having a second groove portion receiving said projection such that as said outside and inside cylindrical sections are rotated relative to one another, said inside and outside cylindrical sections are displaced axially relative to one another, and a catch means operable to prevent return of said projection from said second groove portion to said first groove portion, said catch means comprising a resilient catch part on said other cylindrical section and an abutment on said one cylindrical section which is engageable by said catch part.

2. A submersible electrical appliance according to claim 1, wherein said catch part is integrally formed with said other cylindrical section.

3. A submersible electrical appliance according to claim 1, wherein said one cylindricaly section is said inside cylindrical section and said other cylindrical section is said outside cylindrical section.

4. A submersible electrical appliance according to claim 3, wherein said inside cylindrical section has a second groove, said abutment being at one end of said second groove.

5. A submersible electrical appliance according to claim 3, wherein said resilient catch part comprises a partial circular configuration having one end portion integrally joined to said focusing tube and another end part integrally formed with said catch part.

6. A submersible electrical appliance according to claim 5, wherein said catch part comprises a projection extending radially outwardly of said circularly configured catch part.

7. A submersible electrical appliance according to claim 3, wherein said outside cylindrical section has an axial end portion, said resilient catch part being disposed at said axial end portion.

8. A submersible electrical appliance according to claim 3, wherein said outside cylindrical section has a central axis, at least a part of said second groove portion extending at an acute angle relative to said axis to function as a thread when movably engaged by said projections.

9. A submersible electrical appliance according to claim 8, wherein said first groove portion is disposed parallel to said axis.

10. A submersible electrical appliance according to claim 9, wherein another part of said second groove portion extends perpendicular to said first groove portion.

11. A submersible electrical appliance according to claim 10, wherein said other part of said second groove portion extends to opposite sides of said first groove portion such that said other part of said second groove portion and said first groove portion form a T.

12. A submersible electrical appliance according to claim 3, wherein said resilient catch part has a generally C-shaped configuration having one end portion integrally joined to said tube.

13. A submersible electrical appliance according to claim 1, wherein said sealing means comprises resilient sealing rings disposed between said outside and inside cylindrical sections.

14. A submersible electrical appliance adapted to be connected to a cable, comprising a housing means having a water-tight function chamber and at least one water-tight junction chamber, a lamp means comprising a lamp bulb and a reflector located along a central axis in said water-tight function chamber, a water-tight compression means leading to said junction chamber and providing a water-tight seal for said cable, said housing means having a bulk-head wall separating said function and junction chambers, said bulkhead wall having openings, internal electrical fittings passing through said openings and extending between said function chamber and said junction chamber, said internal electrical fittings being in electrical contact with said lamp means, and water-tight sealing means sealing said internal electrical fittings in said openings to thereby provide a water-tight seal between said water-tight function chamber and said water-tight junction and wherein said housing means comprises a junction chamber housing section and a function chamber housing section, and sealing means providing a water-tight seal between said junction chamber housing section and said function chamber housing section.

15. A submersible electrical appliance according to claim 14, wherein said housing means comprises wall means separating said junction chamber into two separate water-tight junction chamber parts, said openings comprising at least one opening between said function chamber and one of said junction chamber parts and at least one opening between said function chamber and the other of said junction chamber parts, said internal electrical fittings comprising an internal electrical fitting in each of said openings, said water-tight sealing means sealing each of said internal electrical fittings in each of said openings.

16. A submersible electrical appliance according to claim 15, wherein said appliance has a cable leading to each of said junction chamber parts, said water-tight compression means comprises a water-tight compression seal for each of said junction chamber parts providing a water-tight seal for each of said cables.

17. A submersible electrical appliance according to claim 15, wherein said water-tight compression means leads to one of said junction chamber parts, and a seal means having a plug leading to the other of said junction chamber parts.

18. A submersible electrical appliance according to claim 14, wherein said bulkhead wall is integrally formed with said junction chamber housing section.

19. An submersible electrical appliance according to claim 14, wherein said junction chamber housing section has a cavity juxtaposed to said internal electrical fittings and fastening means on said internal electrical fittings and extending into said cavity for fastening said cable to said internal electrical fittings.

20. A submersible electrical appliance according to claim 19, wherein said fastening means comprise threaded elements threaded to said internal electrical fittings.

21. A submersible electrical appliance according to claim 19, wherein said internal electrical fittings comprises elongated pins.

22. A submersible electrical appliance according to claim 19, wherein said junction chamber housing section has a main housing part and a cover means removably mounted on said main housing part, said cover means defining a portion of said cavity to thereby provide access to said fastening means in said cavity upon removal of said cover means from said main housing part.

23. A submersible electrical appliance according to claim 22, wherein said cover means comprises a cover element and fastening means fastening said cover element to said main housing part.

24. A submersible electrical appliance according to claim 23, wherein said bulkhead wall is integral with said main housing part.

25. A submersible electrical appliance according to claim 22, wherein said junction chamber housing section has a generally cylidrical configuration, said junction chamber housing section having a first longitudinal end and a second longitudinal end, said function chamber housing section being disposed on said first end, said cover means being disposed on said second end.

26. A submersible electrical appliance according to claim 25, whereby said cylindrical function chamber housing section has a longitudinal axis, said water-tight compression means for said cably having a cylindrical passage for said cable, said cylindrical passage for said cable having a longitudinal axis which is substantially perpendicular to said longitudinal axis of said cylindrical junction chamber housing section.

* * * * *